US006770011B1

(12) United States Patent
Hinds

(10) Patent No.: US 6,770,011 B1
(45) Date of Patent: Aug. 3, 2004

(54) ELASTIC GRIP EXERCISER

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 202 days.

(21) Appl. No.: 10/184,421

(22) Filed: Jun. 26, 2002

(51) Int. Cl.[7] ..... A63B 21/02; A63B 23/16

(52) U.S. Cl. ..... 482/44; 482/46; 482/49; 482/121; 482/139

(58) Field of Search ..... 482/44–50, 79, 482/121, 122, 126, 127, 139; 463/47.5

(56) References Cited

U.S. PATENT DOCUMENTS

| | | | | | |
|---|---|---|---|---|---|
| 192,338 | A | * | 6/1877 | Marshall | 482/126 |
| 1,137,349 | A | * | 4/1915 | Patterson | 482/127 |
| 2,014,293 | A | * | 9/1935 | Riley | 601/120 |
| 2,994,530 | A | * | 8/1961 | Cohan | 482/49 |
| 3,111,322 | A | * | 11/1963 | English | 473/203 |
| 3,583,394 | A | * | 6/1971 | Napoli et al. | 601/40 |
| 4,036,490 | A | * | 7/1977 | Rice | 482/49 |
| 4,105,200 | A | * | 8/1978 | Unger | 482/44 |
| 4,165,070 | A | * | 8/1979 | Rice | 482/46 |
| 4,711,445 | A | * | 12/1987 | Whitehead | 482/49 |
| 4,840,370 | A | * | 6/1989 | Biddlecombe | 482/49 |
| 4,865,316 | A | * | 9/1989 | Yeaman | 482/126 |
| 5,004,226 | A | * | 4/1991 | Brown, Jr. | 482/126 |
| 5,120,261 | A | * | 6/1992 | Dietzman | 446/473 |
| 5,514,055 | A | * | 5/1996 | Elliott | 482/92 |
| 5,653,664 | A | | 8/1997 | Jennings | |
| 5,681,243 | A | * | 10/1997 | Criss | 482/49 |
| 6,022,303 | A | * | 2/2000 | Abdo | 482/140 |
| 6,224,513 | B1 | | 5/2001 | Chow | |
| 6,293,893 | B1 | * | 9/2001 | Truchelut | 482/121 |
| 6,398,652 | B1 | * | 6/2002 | Schweizer et al. | 463/47.5 |

FOREIGN PATENT DOCUMENTS

| | | | | |
|---|---|---|---|---|
| DE | 4241991 | A1 | * 6/1994 | A63B/23/00 |

* cited by examiner

*Primary Examiner*—Nicholas D. Lucchesi
*Assistant Examiner*—Victor Hwang
(74) *Attorney, Agent, or Firm*—Loyd W. Bonneville

(57) ABSTRACT

An elastic exercising wand which can be squeezed, bent, twisted or pulled to benefit certain muscles; and having an elastic band snugly encircling its length under which the exercising operator may repetitively flex the hand or fingers in expansion exercises against its elastic resistance. A tension adjusting ring and attached anchoring hook are optionally present to control the band's resistance and provide tethering means, respectively.

4 Claims, 6 Drawing Sheets

ELASTIC GRIP EXERCISER

BACKGROUND OF THE INVENTION

1. Field of the Invention

Exercise Equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term elastic cylinder grip (1) might be used in one instance but in another, if meaning is otherwise clear from context, expression might be shortened to cylinder grip (1) or merely grip (1). Any of those forms is intended to convey the same meaning.

The term attach or fasten or any of their forms when so used means that the juncture is of a more or less permanent nature, such as might be accomplished by nails, screws, welds or adhesives. Thus it is stated herein that the connection of the anchoring hook (5) to an end of an elastic cylinder core (2) is one of attachment, A connection in which one object is easily removed from another is described by the word emplace, as where it is stated herein that the elastic exercise band (3) is longitudinally emplaced to enwrap the ends of the cylinder grip (1) and cylinder core (2) and the tension adjusting ring (4), when present, is emplaced to fit radially over the cylindler grip (1), cylinder core (2) and elastic band (3) so as to control the band's (3) effective ring size to provide optimum elasticity. A connection in which two objects, though not attached, could be separated only with considerable difficulty is referred to herein as one of rigid emplacement. The preferred interconnection of the elastic cylinder core (2) and the cylinder grip (7) is stated herein to be such. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that FIG. 6 comprises the perspective view of an end of a cylinder (1) and core (2) into which an anchoring hook (5) has been disposed, meaning that FIG. 6 is in fact that view. The term comprise may also be characterized by what might be considered one-way equivalency, as when it is stated in one instance herein that an elastic cylinder grip (1), elastic cylinder core (2) and anchoring hook (5) comprise the exercise assembly. This means merely that those three objects are the assembly. This use of the word has a generic sense to it. That is, those three components (1, 2, 5), when present, will always be part of an exercise assembly herein but the assembly may include the anchoring hook (5) in one case but something else in another. However, the word comprise may also be used to describe a feature which is part of the structure, composition or character of a given object. Thus, the elastic exercise band (3) is stated to comprise, among other things, ring size sufficient to longitudinally encircle the ends of the grip (1) and core (2). The meaning in the respective cases is clear from context, however. Accordingly, modifying words to clarify which of the three uses is the intended one seem unnecessary.

Terms relating to physical orientation such as top or bottom, upper or lower, refer to the positioning of the assembly in the manner it would be observed during a commonly practiced mode of operation. This convention has been adopted as a matter of convenience in discussing orientation and as shown in the drawings. Thus, one or more of the operator's (100) fingers are said to be slipped beneath the elastic exercise band (3) to permit certain hand and finger expansion exercises.

The word longitudinal and derivations thereof refer merely to the longest dimension of a given object, provided it has one. Thus, it is stated herein that the elastic cylinder core (2) is longitudinally disposed within the cylinder grip (1). This merely means that the core's (2) elongation is oriented in direction the same as that of the grip (1) within which (1) it (2) is disposed. It is also stated herein that the exercise band (3) is stretched to longitudinally enwrap the ends of the grip (1) and core (2). This merely means that the band (2) is elastically fitted to snugly encircle them (1, 2) in the direction of their (1, 2) elongation.

In some cases, the same word expressed as a noun is also used for a verb. Thus, it is stated, for example, that the cylinder core (2) comprises a threaded tunnel (7) with which the anchoring hook's threaded sector (6) engages. Yet, it is also stated that the cylinder core (2) tunnels through the longitudinal extension of the cylinder grip (1). The propriety of this divergent use of the term is established by the dictionary. Occasionally, however, certain words may be coined herein to simplify discussion by interchanging noun, verb or adjective or by modifying certain words. For example, coengage and interthread are terms occasionally applied to describe the relationship of objects brought into conjunction with one another in a particular way-by threading, by the buttressing of one against the other for an intended purpose or by some other mutual interrelationship.

The provision of a squeezable object to strengthen the grip or the arch of the foot began with the small hand-held elastic ball, a part of the public domain at least as early as the 30s, if not long before. U.S. Pat. No. 6,224,513 B1 issued to Chow, featuring a tough elastic core and softer inelastic exterior followed in that tradition. Not long before, in U.S. Pat. No. 5,653,664 issued to Jennings, a pair of squeezable balls dedicated to the same function had been mounted at opposing ends of a golf exercising rod. Those devices aided in hand or foot muscle contraction and, so far as they went, could conceivably have benefitted wrist and forearm pronation and supination with the fist closed under tension. It had been observed, however, that a much higher level of therapeutic or athletic training development would be desirable if the proper tool for conducting more elaborate exercises had been supplied.

In place of the hard rubber-like ball structure, what is needed for the hand and foot contraction exercises thus far practiced is an easy-to-manage object in which a tough elastic core is enwrapped by a special soft elastic material, thereby also permitting wringing exercises involving both hands simultaneously, hand and finger lifting expansion exercises against elastic resistance and vigorous wrist whipping exercises.

SUMMARY OF THE INVENTION

The invention is an elastic grip exerciser comprising at a minimum an elongated elastic cylinder grip (1) and an elastic cylinder core (2) longitudinally disposed within it (1) by means of rigid emplacement. Both comprise elasticity but the composition of the grip (1) is relatively soft—such as sponge rubber, for example—while that of the core (2) is of tougher consistency. The softer exterior permits the operator (100) to derive exercise benefit by squeezing the simple assembly in the palm of the hand or rolling it under the arch of the foot much in the manner one would do with a small exercise ball. The more elastically rigid core (2) provides a back-up against which the grip (1) is squeezed and also permits a variety of wrist and arm exercises in which it (2) provides resistance while being bent into a modified U-shape.

A particularly useful embodiment of the invention involves alternate raising and lowering of the operator's (100) hand or any number of fingers beneath and against the resistance of an elastic exercise band (3) stretched to fit over the assembly's ends. A tension adjusting ring (4) may also be included as a manually operated slider to vary the length—and, therefore, the resistance—of the band's (3) ring size.

An optional feature comprises an anchoring hook (5) driven into the end of the cylinder core (2) which provides tethering possibilities in the assembly's use.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

DESCRIPTION OF THE PREFERRED EMBODIMENT

The subject of this application is an elastic grip wand or exerciser comprising as part of a combination a small but considerably improved assembly for exercising the operator's (100) hand, finger, wrist or arm. By providing within an elastic cylinder (1) an elastic core (2) comprising greater density and rigidity than that of the cylinder (1), a number of beneficial exercises are made possible. The exerciser may be squeezed with the fist, bent to strengthen wrist pronation and supination or by stretching against an elastic exercise band (3), provide a resistance site for hand and finger expansion. It may even be pulled longitudinally as a simple chest expander.

Figure 1:
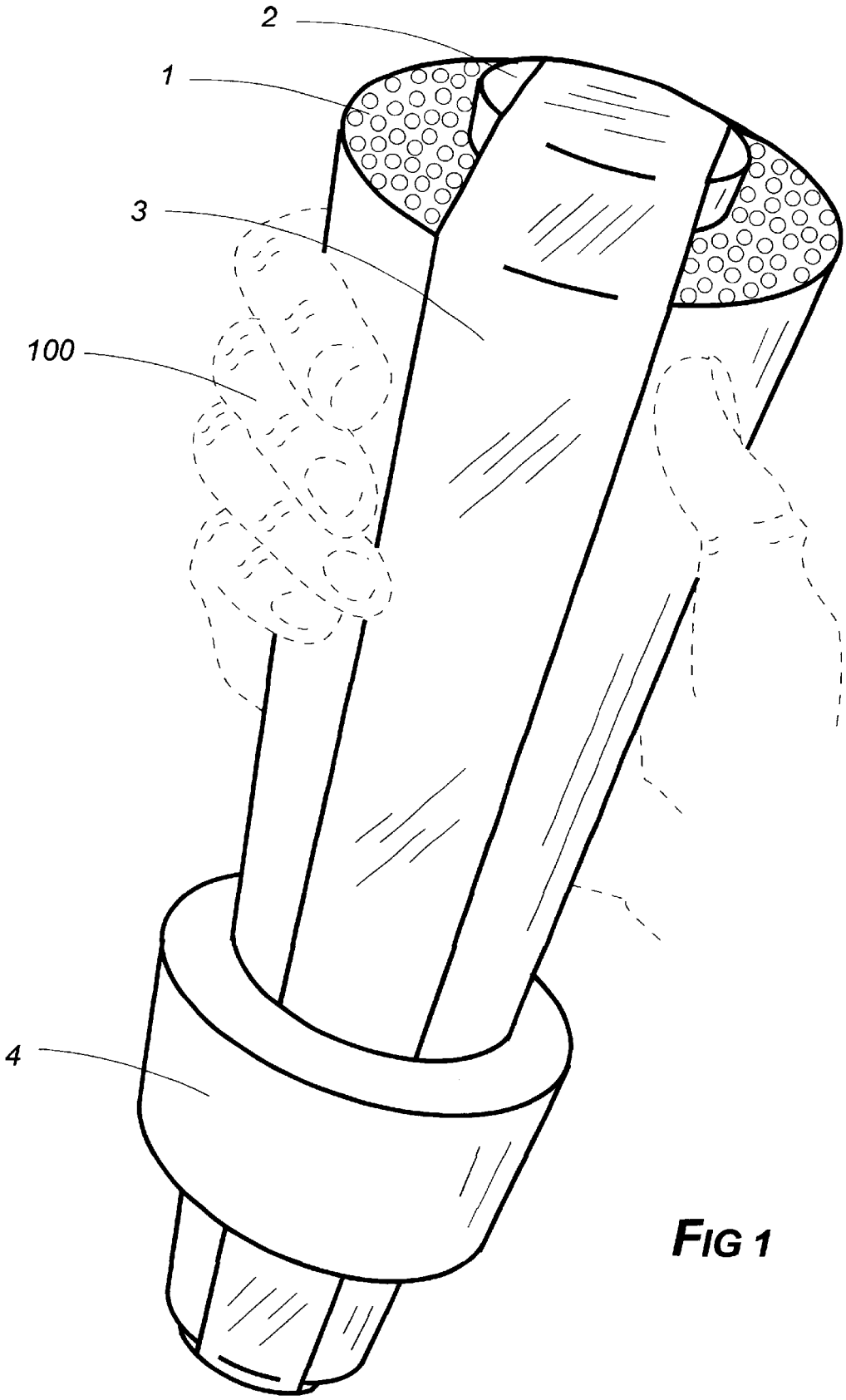
FIG. 1 illustrates an embodiment of the invention comprising the cylinder grip (1), the cylinder core (2) within and the longitudinally enwrapping elastic band (3) together with the tension adjusting ring (4).
Figure 2:
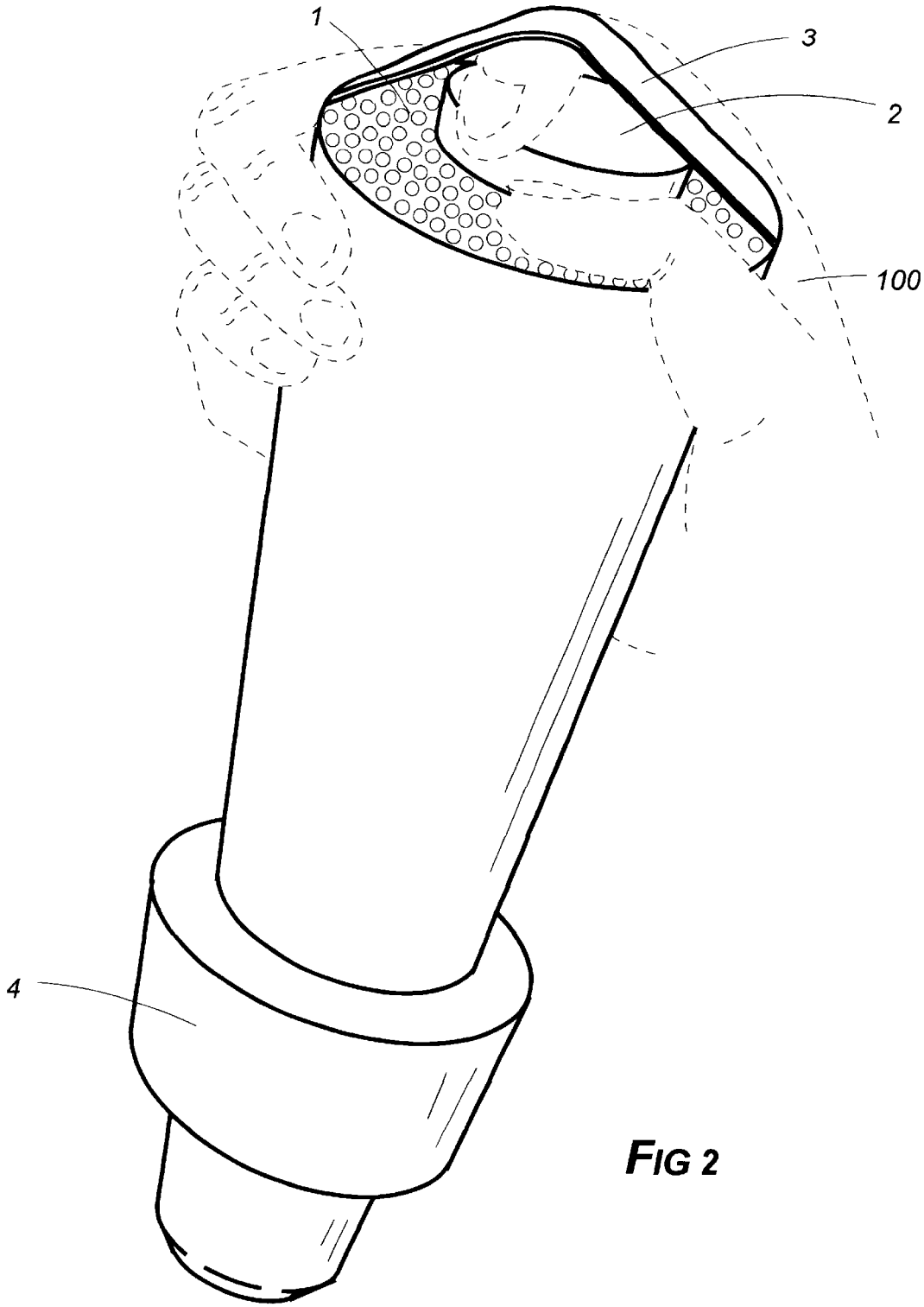
FIG. 2 represents the invention's use in a finger flexing or expansion exercise against the elastic band (3) at a cylinder grip (1) end.
Figure 3:
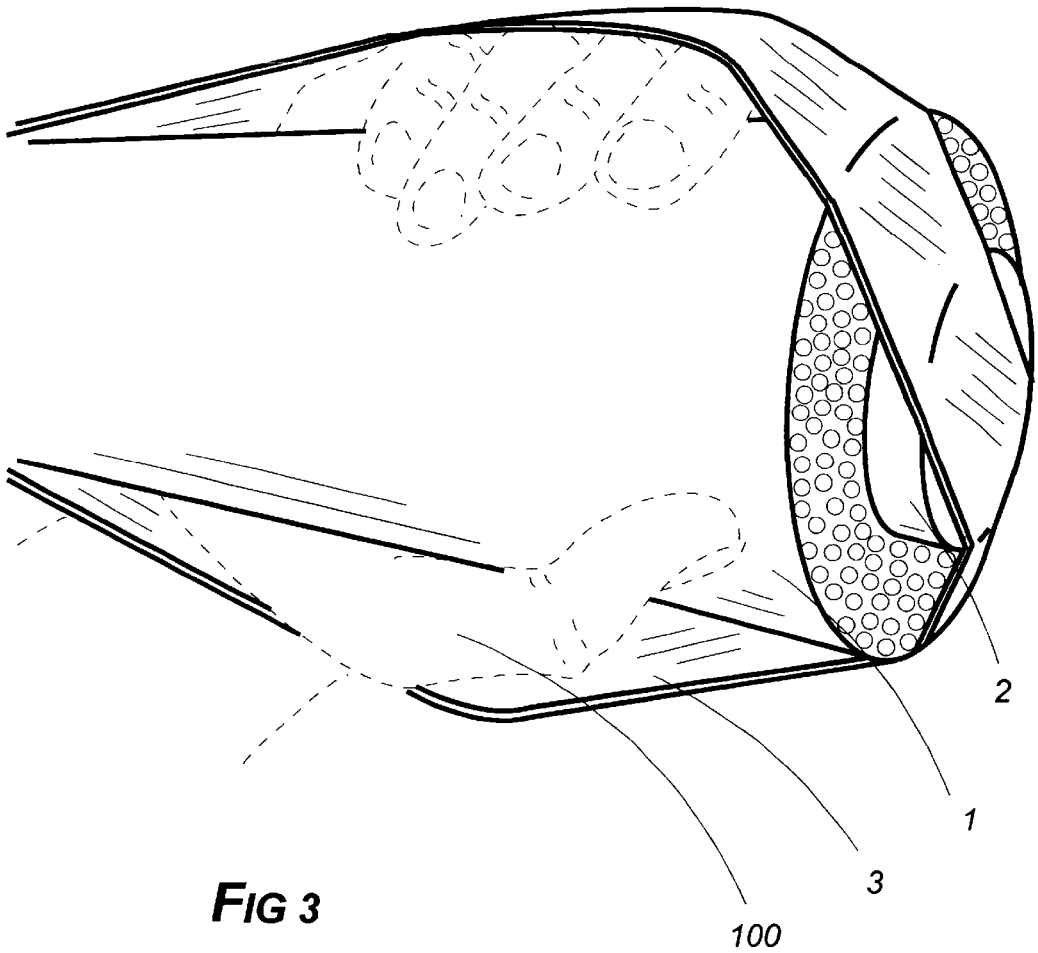
FIG. 3 comprises a perspective view of the invention's use in which the operator (100) emplaces all four fingers beneath the band (3) so as to engage in a flexing hand expansion exercise.
Figure 4:
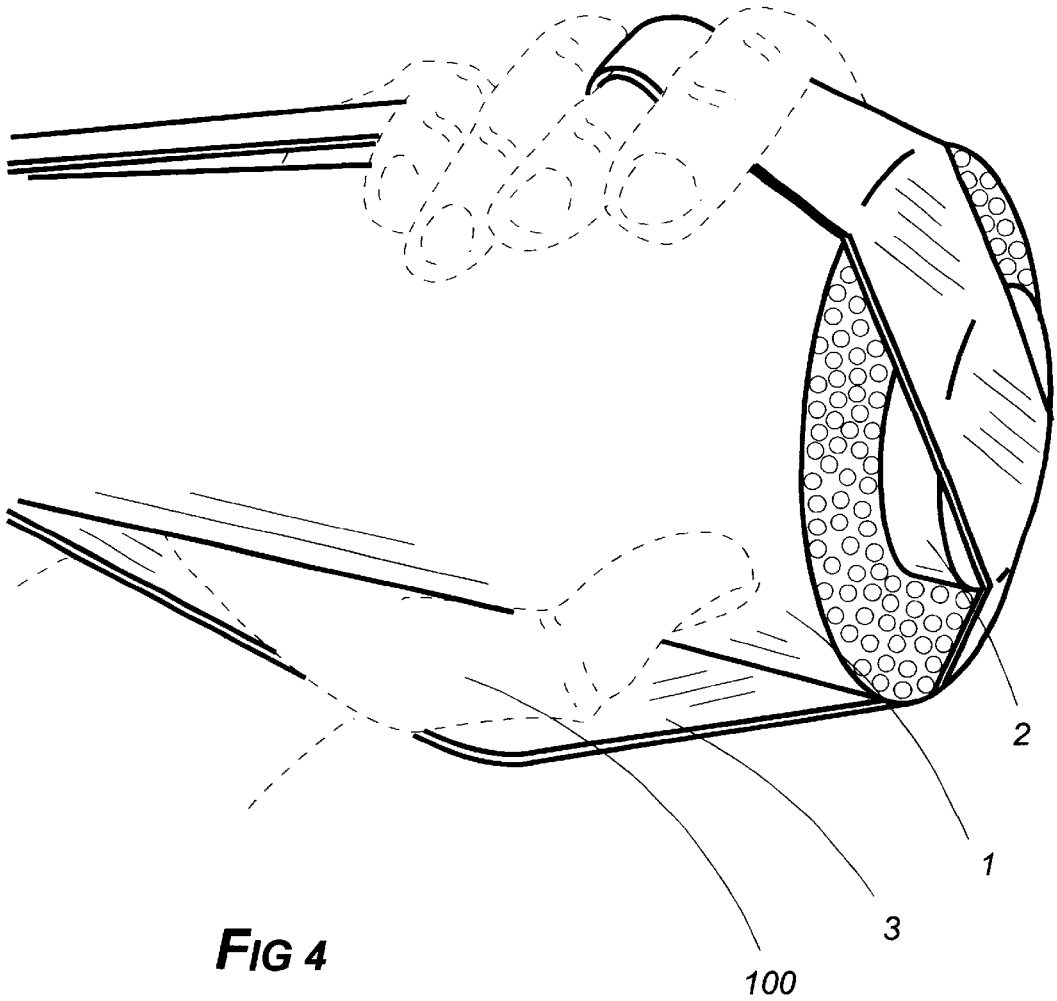
FIG. 4 depicts an emplacement for an expansion exercise wherein but one of the operator's (100) fingers is in position to strain against the band's (3) constriction by the others.
Figure 5:
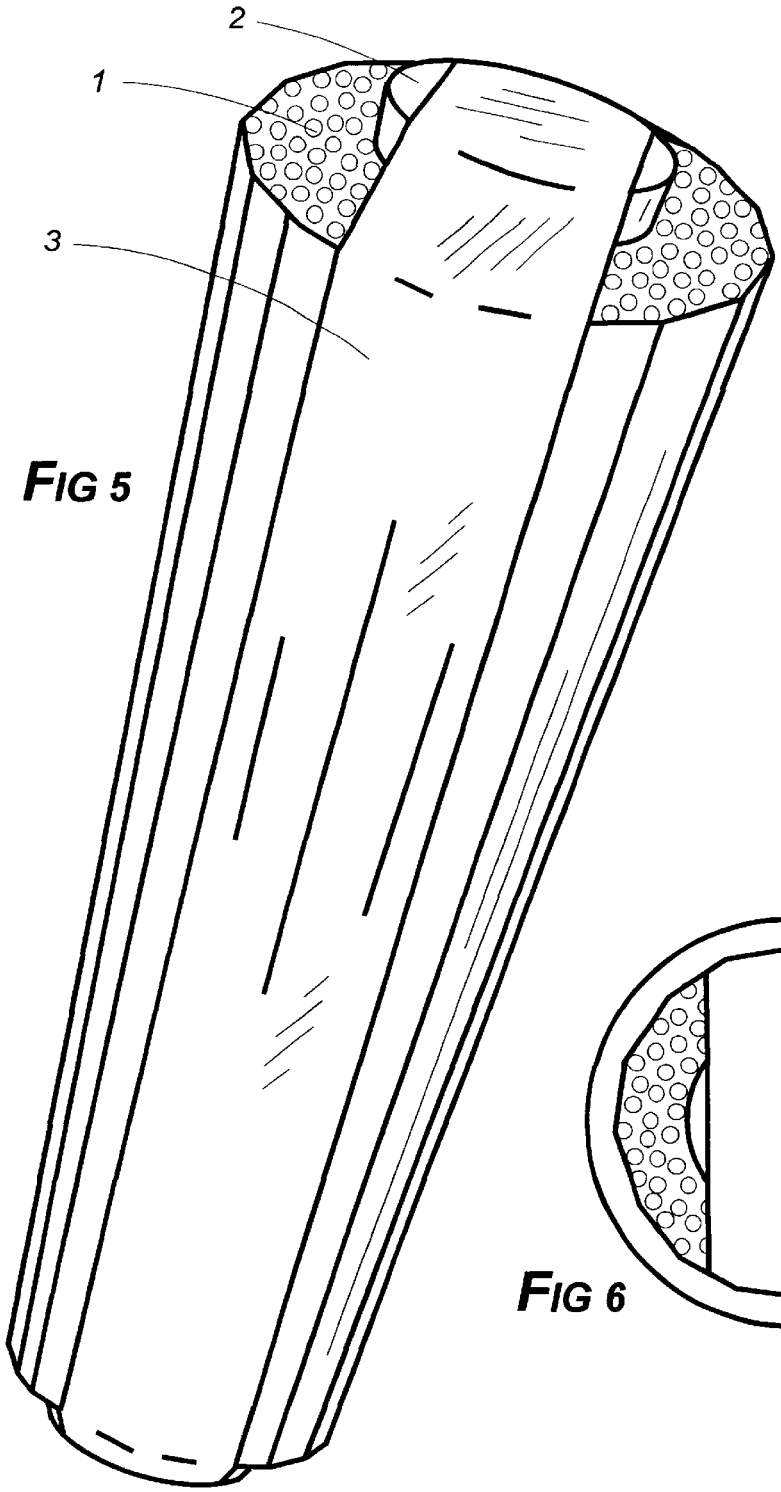
FIGS. 5 and 6 feature an embodiment comprising a polygonal cross-section—a longitudinal perspective and a radial cross-section, respectively.
Figure 6:
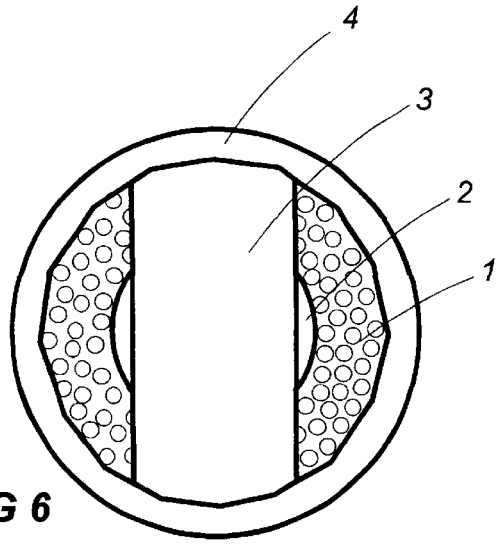
Figure 7:
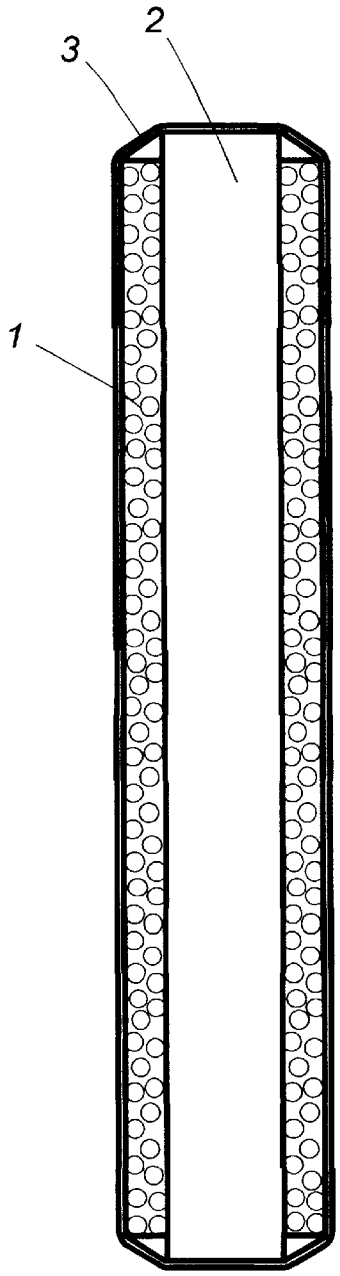
FIG. 7 illustrates a longitudinal cross-section of a polygonal embodiment of the invention.
Figure 8:
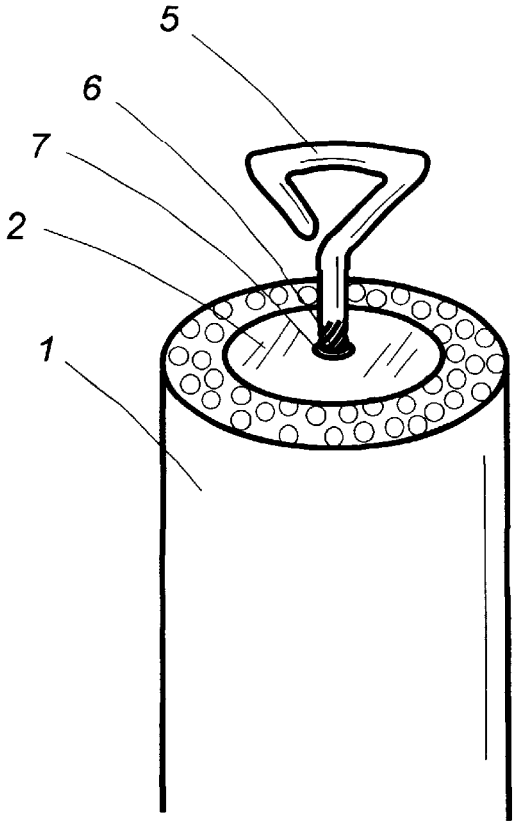
FIG. 8 comprises a perspective view of an end of a cylinder (1) and core (2) into which an anchoring hook (5) has been interthreaded, showing both the threaded sector (6) and tunnel (7).

In its bare essentials, the invention comprises the elastic cylinder grip (1) and elastic cylinder core (2) briefly alluded to supra. The former (1) is elongated, comprising tubular configuration and soft elastic composition—preferably sponge-like. While in cross-section, its (1) circumference is preferably circular, as shown in FIGS. 1–4 and 8, it may instead be polygonal, as shown in FIGS. 5 and 6, thereby providing convenient gripping ridges. Its (1) tube-like walls are relatively thickened, occupying in width up to perhaps one-fourth of the diameter.

The core (2), also elongated but rod-like, comprises smaller diameter and firmer elastic composition than the former (1)—that is, of density exceeding that of it (1)—and is disposed within it (1) along its (1) longitudinal axis such that the two (1, 2) preferably exhibit a co-centric radial cross-section. The core's (2) diameter is such that it (2) fits snugly within the grip's (1) longitudinal cavity. It (2) preferably comprises slightly greater length than the grip (1), allowing it (2) to protrude slightly at each end. While it would be feasible to attach the two (1, 2)—such as with an adhesive—experience demonstrates that they are firmly held together by their (1, 2) mutual elasticity. The grip (1) is fitted over the core (2) in manufacture and their interconnection may, therefore, be properly described as one of rigid emplacement.

Because of the respective elastic character of each (1, 2), the softer and spongier grip (1) may be squeezed upon the tougher cylinder core (2) more or less in the manner done with a palm held exercise ball. Similarly, it (1) may also be rolled under the foot to strengthen the arch. The optimum consistency of the grip (1) depends, of course, upon the relative strength and needs of the particular operator (100). The more durable core (2) should be much less compressible when gripped but should, nevertheless, comprise sufficient elasticity to provide beneficial exercise resistance to the operator (100) when bent longitudinally more or less into a U-shape—for example, as when gripping one end by hand and bending the other end against a tabletop; or employing both hands in opposing fashion. It may also be employed in vigorous lateral whipping oscillation exercises.

Although a great many exercises may be conducted with merely the foregoing components (1, 2), an additional class of important beneficial exercises are provided by adding to the assembly an elastic exercise band (3). The exercise band (3) is stated herein to longitudinally enwrap the cylinder grip (1) and core (2). By that is meant that the band (3), preferably a little less than an inch in width, comprises ring size such that it must be stretched to tightly encircle the length of the grip (1) and (2) core within as pictured in FIGS. 1–7 Experience dictates that the band (3) should be relatively thin but of composition strong enough to endure frequent use and aging. Once in place, one or more of the fingers are slipped beneath it (3) and, in response to its (3) inherent elastic resistance, alternately flexed—that is, raised against and lowered—in hand and finger expansion and related exercises. As with the cylinder grip (1), supra, the band's (3) optimum elasticity depends upon the strength and needs of the particular operator (100). Ideally, there would be provided an assortment of bands (3) of varying elasticity to choose from.

Another addition to the assembly which enhances its use is a tension adjusting ring (4). It is recognized that the smaller the size of an elastic segment, the greater its resistance. The adjusting ring (4) provides means to effectively vary the length of the elastic exercise band (3) longitudinally emplaced over the grip (1) and core (2). The ring (4) comprises a preferably inelastic—annulus of size such that it (4) is emplaced to fit radially over the grip (1), core (2) and band (3) just snugly enough to permit it (4) to be slid along the length thereof (1–3) without slipping off. The position to which it (4) is moved changes the effective length of the elastic band (3) and, thereby, controlling its (3) tension for optimum elasticity.

To permit an ever increasing but different variety of exercises, a cylinder grip (1), cylinder core (2) and an anchoring hook (5) axially disposed into one or both of the core's (2) ends for tethering purposes may comprise the exercise assembly. For example, the hook (5) might be connected with an elastic exercise cord to an exercise framework; and, if hooks (5) were thus installed at both ends, the cord might be looped around a convenient anchor. The assembly could then be employed in various pulling or tugging repetition exercises including those involving the arms, chest, torso or legs.

Any connection to an elastic exercise object should be sufficiently secure, of course, to prevent its being pulled loose. The hook's (5) connection should, therefore, be one of attachment, supra. Preferably, the hook (5), therefore, comprises a threaded sector (6) which engages a threaded tunnel (7) at the core's (2) end.

If an operator (100) in a given exercise session opted to use an assembly with one or more anchoring hooks (5) installed and then in another, to use an assembly for hand and finger expansion exercises in which the elastic band (3) is employed, by reason of the inconsistency in construction, two separate assemblies should be available. In view of the simplicity of manufacture and consequent anticipated low acquisition cost, this should not prove a difficulty.

The inventor hereby claims:

1. An elastic grip exerciser comprising an elongated elastic cylinder grip; and an elastic cylinder core longitudinally disposed within the cylinder grip by means of rigid emplacement; the cylinder core comprising composition of density exceeding that of the grip;

whereby an operator may conduct squeezing, wrist and arm bending tension, lateral whipping oscillation and related exercises, and an elastic exercise band disposed to longitudinally enwrap the cylinder grip and core, whereby an operator may additionally conduct hand or finger expansion and related exercises.

2. The elastic grip exerciser according to claim 1 further comprising a tension adjusting ring;

whereby the tension on the elastic exercise band may be controlled for optimum elasticity.

3. The elastic grip exerciser according to claim 1 further comprising an axially disposed anchoring hook disposed into the end of the cylinder core by means of attachment.

4. The elastic grip exerciser according to claim 3 wherein the means of attachment comprises interthreading an anchoring hook threaded sector into a threaded tunnel disposed into the end of the cylinder core;

whereby the security of the connection is enhanced.

* * * * *